US006712669B1

(12) United States Patent
Chang

(10) Patent No.: US 6,712,669 B1
(45) Date of Patent: Mar. 30, 2004

(54) BPSG CHEMICAL MECHANICAL PLANARIZATION PROCESS CONTROL FOR PRODUCTION CONTROL AND COST SAVINGS

(75) Inventor: Chin-Chu Chang, Tai-chung (TW)

(73) Assignee: Tawain Semiconductor Manufacturing Company, Hsin-Chu (TW)

( * ) Notice: Subject to any disclaimer, the term of this patent is extended or adjusted under 35 U.S.C. 154(b) by 21 days.

(21) Appl. No.: 09/784,245

(22) Filed: Feb. 15, 2001

(51) Int. Cl.[7] ..... B24B 49/00
(52) U.S. Cl. ..... 451/5; 451/8
(58) Field of Search ..... 451/5, 8, 41, 57; 438/692, 693

(56) References Cited

U.S. PATENT DOCUMENTS 5,910,846 A 6/1999 Sandhu
5,948,203 A 9/1999 Wang
5,949,927 A 9/1999 Tang
6,071,177 A 6/2000 Lin et al.
6,276,987 B1 * 8/2001 Li et al. ..... 451/5
6,309,276 B1 * 10/2001 Tsai et al. ..... 451/5
6,361,646 B1 * 3/2002 Bibby et al. ..... 216/85
6,399,501 B2 * 6/2002 Birang et al. ..... 438/692

* cited by examiner

*Primary Examiner*—Dung Van Nguyen
(74) *Attorney, Agent, or Firm*—George O. Saile; Stephen B. Ackerman; Douglas R. Schnabel

(57) ABSTRACT

The polishing of a layer of boro-phosphate-silicate-glass (BPSG) is not easy to control as a result of CMP slurry chemistry effects, the doping concentration of the layer of BPSG and the heat treatment to which the layer of BPSG has been submitted prior to the process of CMP. The invention has developed a CMP endpoint detection mode that minimizes variations of the process of CMP of a layer of BPSG by these factors. An endpoint detection algorithm has been developed, which has been applied and has proven to significantly improve a statistical measure, which reflects the process deviation from the process mean for the process of CMP of a layer of BPSG.

9 Claims, 2 Drawing Sheets

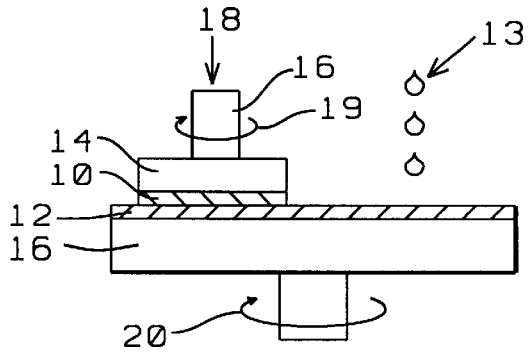
FIG. 1 – Prior Art
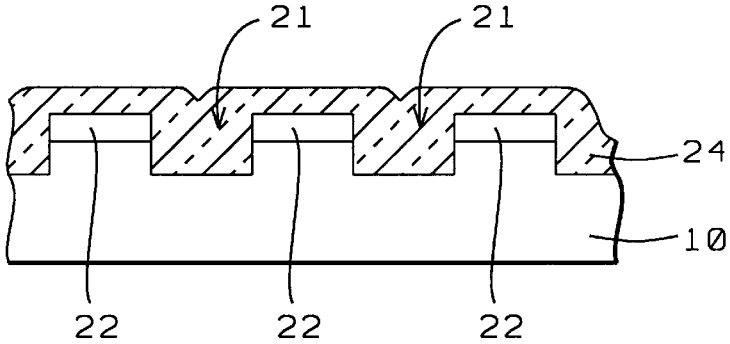
FIG. 2a – Prior Art
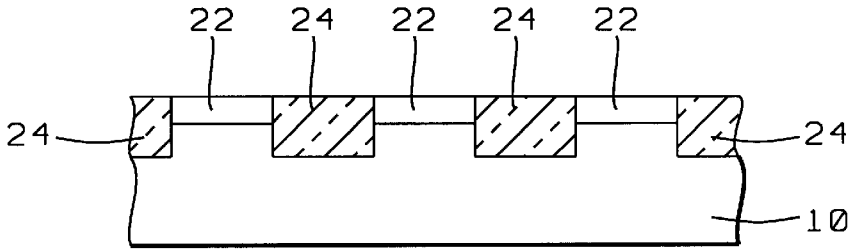
FIG. 2b – Prior Art

BPSG CHEMICAL MECHANICAL PLANARIZATION PROCESS CONTROL FOR PRODUCTION CONTROL AND COST SAVINGS

BACKGROUND OF THE INVENTION (1) Field of the Invention

The invention relates to the fabrication of integrated circuit devices, and more particularly, to a method of successfully modeling different end-point mode functions in order to maintain a constant and stable end-point detection curve for Chemical Mechanical Polishing (CMP).

(2) Description of the Prior Art

Inter-linear device distances have, over the years, become increasingly short due to the continued emphasis on semiconductor device performance improvements and device miniaturization. Semiconductor technological has evolved from Large Scale Integrated (LSI) devices to Very Large Scale Integration (VLSI) devices and ultimately to Ultra Large Scale Integration (ULSI) devices.

Photolithography is one of the predominant technologies that is used for the creation of semiconductor devices, photolithography advances are aimed at the creation of increasingly shallower focal depths that are needed for the creation of images in target surfaces. Due to the increasingly shallower focal depth, increased planarity of the target surfaces must be achieved. The reason for this is that a large step in a semiconductor surface, that is an abrupt change in the planarity of the surface, can have a severely negative impact on step coverage for the surface. If the gradation of the surface is too severe, poor deposition of for instance an overlying layer of metal can result, making it difficult to achieve a reliable semiconductor device. Further increases in semiconductor device density have frequently been achieved by implementing multi-layered configurations. This places further demands on the planarity of the surface over which overlying semiconductor device features are created. Optimum surface planarity has in recent years been obtained by applying methods of Chemical Mechanical Polishing (CMP) whereby semiconductor surfaces such as semiconductor substrates are uniformly polished to a high degree of planarity. The process is used to not only planarize semiconductor slices prior to the fabrication of semiconductor circuitry thereon, but is also used for the removal of high elevation features, which are created during the fabrication of the microelectronic circuitry on the substrate.

A brief overview will be given at this time of the CMP process. A CMP apparatus typically consists of a rotating polishing platen on the surface of which an abrasive polishing pad is mounted. A wafer is mounted on the surface of a second rotating part, the wafer carrier. The surface of the rotating wafer is the surface that is to be polished. The mounting of the wafer to the wafer carrier is frequently achieved by means of a clamp ring. The surface of the rotating wafer is brought in contact with the rotating polishing pad, a slurry is distributed over the surface of the rotating wafer. The chemical slurry, which frequently includes abrasive materials, is maintained on the polishing pad with the objective of modifying the polishing characteristics of the polishing pad, enhancing the polishing of the substrate.

The process of chemical mechanical polishing to planarize semiconductor substrates is not without problems. These problems are typically more pronounced where the process of CMP is used to remove high elevation features, which have been created during the fabrication of microelectronic circuitry on the surface of the substrate. One of the most serious problems that is experienced in using chemical mechanical polishing is the limited ability to predict or control the rate and uniformity at which material is removed from the surface that is being polished. CMP is therefore as yet a labor-intensive process, since surface thickness and uniformity must be frequently monitored during the process of CMP in order to prevent over-polishing or inconsistent polishing of the substrate surface.

Of special concern in this respect is the non-homogeneous replenishment of slurry on the surface of the substrate and the polishing pad. The slurry is primarily used to enhance the rate at which selected materials are removed from the substrate surface. Non-homogeneous replenishment of slurry on the surface that is being polished contributes to unpredictability and non-uniformity of the polishing rate of the CMP process. In view of the fact that a fixed volume of slurry, which is in contact with the surface that is being polished, reacts with materials on the surface that is being polished, this fixed volume of slurry becomes less reactive as the process of polishing proceeds. As a consequence, the polishing enhancing characteristics of the fixed volume of slurry are significantly reduced during polishing. To counter this problem, fresh slurry is continuously provided to the surface of the polishing pad.

This latter approach presents at least two problems. Because of the physical configuration of the polishing apparatus, introducing fresh slurry into the area of contact between the substrate and the polishing pad is difficult. Providing a fresh supply of slurry to all locations on the surface of the substrate is even more difficult. As a result, the uniformity and the overall rate of polishing are significantly affected as the slurry reacts with the surface of the substrate that is being polished.

FIG. 1 shows a Prior Art CMP apparatus. A polishing pad 12 is attached to a polishing table 16, rotating in a direction indicated by arrow 20 at a rate in the order of 1 to 200 RPM. A wafer carrier 14 holds wafer 10 (face down) against a polishing pad 12. Wafer 10 is held in place by applying a vacuum (not shown) to the backside of the wafer 10. Wafer carrier 14 also rotates, indicated by arrow 19, typically in the same direction as polishing table 16, rotating at a rate of about 1 to 200 RPM. The wafer traverses a circular polishing path over the polishing pad 12, due to the rotation of polishing table 16. Force 18 can also be applied against wafer 10 in the downward vertical direction and press the wafer 10 against the polishing pad 12 during the process of polishing. Force 18 is typically between about 0 and 15 pounds per square inch, force 18 is applied by shaft 17 that is attached to the back of wafer carrier 14. Slurry 13 is provided to the top of the polishing pad 12, this further enhances the polishing action of polishing pad 12.

The Prior Art method that is highlighted in FIG. 1 encounters a number of problems and concerns. For instance, abrasive polishing particles are lodged in and held by the polishing pad. By using the polishing pad, the fibers of the polishing pad deteriorate, causing abrasive particle retention within the polishing pad to diminish, reducing the polishing characteristics of the polishing pad. Also, due to the pressure that is applied to the wafer, the contact between the polishing pad and the wafer is intense and does not allow for an even distribution of the polishing slurry across the surface that is being polished. In addition, the abrasive particles that essentially affect the polishing action are, during the polishing process, reduced in size, further affecting the polishing characteristics of the process.

FIGS. 2*a* and 2*b* give an example of the process of Chemical Mechanical Polishing (CMP). The example that is shown in FIGS. 2*a* and 2*b* is purposely kept simple and can readily be expanded to more complex examples of CMP. For all of these examples, the polishing process is essentially as the example that is shown in FIGS. 2*a* and 2*b*. Over a semiconductor surface 10, for instance the surface of a silicon substrate, a layer 22 of for instance silicon nitride is deposited, patterned and etched, creating openings or trenches 21 through the layer 22 and into the underlying semiconductor surface. These trenches have been filled with an overlying layer 24, for instance comprising silicon oxide. It is the objective to fill the trenches 21 that have been created in layer 22 and the underlying semiconductor surface with a material. To achieve this objective, it is clear from FIG. 2*a* that the layer 24 must be removed from above the plane that contains the surface of layer 22. CMP is therefore applied to the surface of layer 24, removing this layer starting from the surface of the layer 24 and proceeding until the surface of layer 22 is reached. The results of the CMP process are shown in FIG. 2*b*, indicating that the objective of filling the trenches that have been created through layer 22 and into the surface 10 has been achieved. Numerous variations of the simplified example, shown in FIGS. 2*a* and 2*b*, of a processing environment where CMP is applied need not be further detailed at this time since these variations may change in particulars but not in the essential process as shown in FIGS. 2*a* and 2*b*.

Where FIGS. 1, 2*a* and 2*b* have shown the principle of the methods that are used to implement surface polishing, an equally important aspect of surface polishing is to observe the status during and the results after the polishing. The invention provides a method that addresses semiconductor surface polishing.

U.S. Pat. No. 6,071,177 (Lin et al.) shows an endpoint method for a CMP process by utilizing a dual wavelength interference technique.

U.S. Pat. No. 5,949,927 (Tang), U.S. Pat. No. 5,948,203 (Wang) and U.S. Pat. No. 5,910,846 (Sandu) show other CMP endpoint methods.

SUMMARY OF THE INVENTION

It is an objective of the invention to successfully model different end-point mode functions in order to keep a constant and stable endpoint detection curve.

It is another objective of the invention to establish an optimum CMP pre-thickness of the layer that is being polished such that the end point failure rate of the CMP process for a layer of boro-phosphate-silicate-glass (BPSG) approaches zero.

It is a further objective of the invention to significantly improve the statistical measure of the process deviation from a process mean for the process of polishing a layer of BPSG using methods of CMP.

The polishing of a layer of boro-phosphate-silicate-glass (BPSG) is not easy to control as a result of the CMP slurry chemistry effects, the doping concentration of the layer of BPSG and the heat treatment to which the layer of BPSG has been submitted prior to the process of CMP. The invention has developed a CMP endpoint detection mode that minimizes variations on the process of CMP of a layer of BPSG by these factors. An endpoint detection algorithm has been developed, which has been applied and has proven to significantly improve a statistical measure, which indicates the process deviation from a process mean for the process of CMP of a layer of BPSG.

BRIEF DESCRIPTION OF THE DRAWINGS

FIG. 1 shows a Prior Art method of chemical Mechanical Polishing.

FIGS. 2*a* and 2*b* show cross sections of a surface that is polished using Prior Art methods, as follows:

FIG. 2*a* shows a cross section prior to the process of CMP,

FIG. 2*b* shows a cross section at the completion of the process of CMP.

DESCRIPTION OF THE PREFERRED EMBODIMENTS

Figure 3:
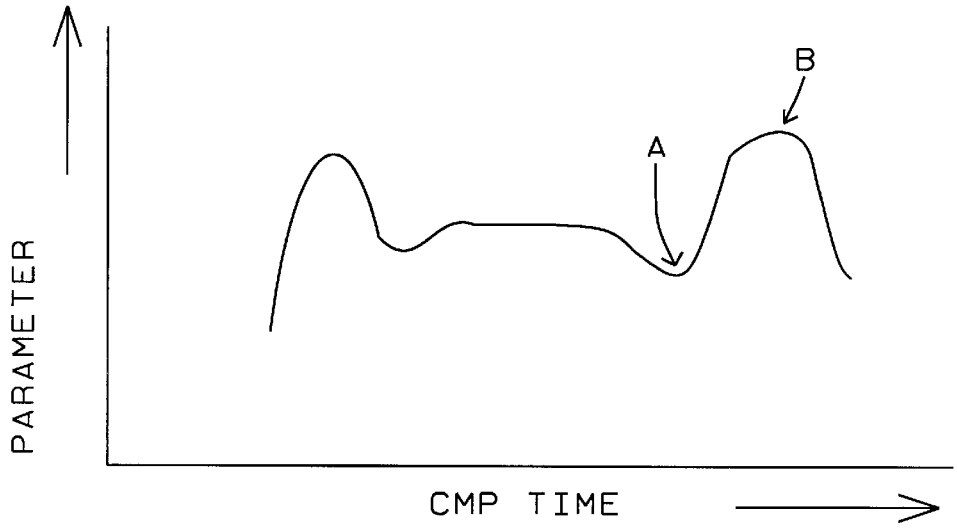
FIG. 3 shows a characteristic CMP end-point signal profile that can be observed for a layer that is polished, providing a method for monitoring progress or status of the CMP process.

Various endpoint detection functions have been investigated for the process of Chemical Mechanical Polishing of a layer of BPSG, a layer of BPSG is typically used to create DRAM devices. A simulation tool (software package) has been used for this purpose.

It is well known in the art that the removal rate of BPSG is not easy to control. This is generally attributed to the effects that the chemical composition of the polishing slurry and the layer of BPSG have on the CMP process. This is further contributed to effects of the concentration of impurity doping of the layer of BPSG and to the heat treatment that the polished layer of BPSG has been subjected to prior to the CMP process. The invention however has successfully developed an endpoint mode polish, which results in excellent Statistical Process Control (SPC) of the polishing of a layer of BPSG.

Boro-Phosphate-Silicate-Glass (BPSG) has been widely used in the semiconductor industry in creating interlayer dielectric films. For these applications, BPSG offers the advantages of good gap filling and of providing an effective barrier against alkali ion migration towards sensitive device regions. Furthermore, the addition of boron to BPSG films effectively lowers the glass transition temperature of oxide films, enabling oxide films to flow at relatively low temperature. Thus, BPSG can be used to fill high aspect ratio openings while at the same time providing surface smoothing of the topography of stacked DRAM devices. For advanced DRAM applications however the traditional BPSG re-flow process cannot provide the required global planarization needed for processes of photolithography and etching. For this reason, a deposited layer of BPSG for DRAM devices is polished using methods of CMP, which provides good surface planarity and uniformity.

It has been observed that, when applying identical polishing conditions, the removal rate of doped oxide is much higher than the removal rate of non-doped oxide. In addition, the polishing rate of BPSG films is affected by the concentration of the impurity doping that has been applied to the layer of BPSG and by heat treatment to which the layer of BPSG has been exposed. Dissolution of BPSG in polishing slurry with a pH ranging from about 10 to 12 proceeds relatively fast. This slurry chemistry enhances the polishing rate of a layer of BPSG during the process of CMP. In order to overcome the indicated effects and dependencies, an end-point mode process has been developed for the control of the BPSG polishing process.

One critical aspect of applying processes of CMP is the method that is used for monitoring the status or results of the CMP process. It must be possible to examine the surface qualities of the surface that is being polished.

Conventional methods of observing the results of the process of CMP visually observe the polished surface by using a Scanning Electron Microscope (SEM). A cross section is made for this purpose of the surface that has been polished, the cross section is visually examined using the SEM. This examination of the cross section of the polished surface measures surface parameters that identify the topography of the surface. For instance, where this surface overlies a trench that has been created in an underlying layer, the method may measure the thickness of the polished layer (at the lowest point) over the trench and (at the highest point) over the surrounding material in which the trench is embedded. This measurement can be extended over a crosscut of the surface that is polished, so that variations (in the calculated measurements) between for instance the center of the surface that is polished and the perimeter of the surface that is polished can be observed.

Another way to determine the end-point of a CMP process is allocating, based on previously obtained experimental data, an amount of time for the CMP process and stopping the CMP process after this time period has transpired. Predictions can be made relating to the time that is required to polish a particular surface, based on previous results and assuming that known conditions of polish are maintained. This method however readily leads to over-polishing the surface, resulting in lost product, or under-polish resulting in the resumption of the process of polishing over a time period that is difficult to predict.

One of the methods that is used to monitor the extent to which a surface has been reduced in thickness is a CMP end-point detection signal or curve. Endpoint detection involves the measurement of some property that is associated with a process, such as a film thickness or the chemical composition of the chamber ambient. The CMP end-point detection signal is best observed by plotting the detected parameter along the vertical or Y-axis while plotting the CMP time along the horizontal or X-axis. Under identical conditions of CMP and identical conditions of film surface and the surface that is being polished, the CMP end-point detection profile has a known and constant profile, assuming that the film that is being polished is thick enough. If the film that is being polished is not thick enough the CMP end-point detection profile of the films that are being polished will vary considerably.

More specifically will be addressed at this time the characteristics of the CMP end-point signal vs. time as shown in FIG. 3. The example that is shown in FIG. 3 is representative of the relationship between the parameter that is being measured vs. CMP polishing time. Parameter vs. time relationships can be observed for layers or films of various thicknesses, assuming that these layers are polished under identical conditions of polish and identical conditions of the surface or layer that is being polished and identical conditions of surface to which the polish must proceed. The latter conditions are mostly conditions of the material that is contained in the layer that is processed and the processing conditions (heat treatment and the like) that the surface that is polished has been subjected to prior to the polishing. Conditions of polish are the standard conditions that have previously been addressed under FIG. 1 such as the pressure that is applied to the surface that is polished, absolute and relative rotational speed of the rotating wafer surface and the rotating polishing pad, slurry parameters such as slurry content (pH or chemical composition), slurry temperature and slurry distribution over the polished surface.

Two points can clearly be identified in the curve that is shown in FIG. 3, that is:

point A, the point where the parameter vs. time curve starts to rise relatively steeply, and point B, the point where the steep rise in the parameter vs. time curve ends and changes into a steep decline.

Point A has been identified as the point where the planarization is almost complete and is therefore also referred to as the point where a "pre-planarized" (almost planarized) surface has been reached. Point B is the point where the planarization is complete and therefore must be halted. Using the polishing of a tungsten surface as an example, if polishing is continued after reaching point B, the surface of the metal (tungsten) film will become exposed (patch-like oxide will become visible).

It must further be stated and relating to end-point signal profiles that an end-point profile will typically be dependent on and will vary with different materials (for the film that is polished and for the surface over which the film has been deposited). For example, the end-point signal for a tungsten layer will first show a peak after which the curve decreases at the time that the polished layer has reached a desired thickness. By contrast, other deposited films may have other profiles and may for instance have a valley in the end-point signal curve.

It must be emphasized that it is essential to the accuracy of the endpoint detection curve that, prior to the process, a "pre-planarized" layer must be present, that is the layer that is being polished must have a certain minimum thickness.

The above highlighted difficulties that are experienced in monitoring the CMP process for a layer of BPSG can be addressed in one of the following three manners:

by rate mode polishing by time mode polishing, and by endpoint mode polishing.

The first of these three methods, the rate mode processing, uses the observation that, under known conditions of CMP, the rate at which the layer that is polished is removed is known. The rate mode method is more expensive than other methods and, in addition, requires verification of the status of the surface that is being polishing that must be performed as a separate step and operation ("ex-situ") that is not incorporated into the process of CMP.

The second of these three methods, the time mode polishing, makes use of previous experiments that have provided data as to the time that is required, under known conditions of CMP, to remove a thickness of a layer of known composition. Time mode polishing implies performing calculations prior to the process of CMP that relate to the wafer that is being polished, which lowers the polishing throughput or efficiency.

The third of these three methods, the endpoint mode polishing, uses the observed endpoint profile and determines when the process of CMP is complete based on characteristics of this endpoint profile. The invention concentrates on the latter method and has found not only that this method provides best results but has, in addition, provided insight under which condition of CMP the endpoint method provides best results. The endpoint method of controlling polishing status is considered the more sophisticated method of the three, this method however has the disadvantage that the alhorithm that is used to predict optimum results, using simulation software, is complicated and therefore difficult to adjust ("fine-tune"). The invention has concentrate on this latter effort. The invention has, as part of this effort:

collected and analyzed endpoint curve data for the CMP of BPSG layers fine tuned the algorithm that is used to predict (simulate) optimum polishing results for a layer of BPSG such that the endpoint cure is repeatble and therefore dependable, and performed the above analysis for deposited layers of BPSG that have different thicknesses.

The experiments that have been conducted by the invention have used a three platen polishing apparatus. The third of these three platen was used to overpolish the surface of BPSG to eliminate scratches. This polish on the third platen used time mode polishing and is therefore not of direct interest to the invention. The wafers that have been used for the experiments have been prepared for the experiments by Sub-Atmospheric CVD (SACVD) deposition of TEOS+TEB+TEPO and by performing a surface reflow of the deposited layers at about 850 degrees C. in a $N_2$ environment for about 10 minutes.

For the initial phase of the experiments of the invention, a time mode polish was performed on the first platen with the time being varied between 25 and 35 seconds in increments of 5 seconds. It was found that for this sequence there was too little of the layer of BPSG left for the detection of an endpoint profile using the second platen. This "too little" demonstrated itself in the fact that no dependable (of proper and constant shape) endpoint detection curve could be detected under these conditions. Because of this, processing variables were adjusted in order to create a more productive experiment. The parameters that were adjusted and that were submitted to the CMP simulator (software package) are the following:

- the initial dead time; this time is the elapsed time after all the conditions for the initiation of the CMP process have been established and activated; this time is required by the CMP apparatus and the supporting equipment to "settle down", that is to eliminate any random noise that may be present in the system
- detect window height, the window is a planar section that is extracted from the endpoint response curve over which the endpoint response curve is analyzed
- the detect window time, that is the time at which the window is activated, that is the time (within the CMP time) at which the endpoint profile is analyzed
- the numbers of windows out; this is the occurrence whereby the end-point curve penetrates the window by entering the window at a ninety degree angle, making a sharp angle and exciting the window in either the upper boundary (side) or the lower boundary (side) of the window. This endpoint curve trajectory must be differentiated from the window-in endpoint curve whereby the endpoint curve again enters the window under an angle of ninety degree and proceeds in a straight path through the window, exiting the side of the window that is opposite to the side of the window through which the endpoint curve entered the window and under an angle of essentially ninety degrees with the exit side
- the period over which the signal that is observed is to be averaged
- the number of periods that are to be averaged
- the bandpass period
- the number of bandpass cycles
- the derivative time
- the addition or lack of addition of filters, applied to the parameters that are observed, and
- the averaging or not averaging of the parameters that are observed.

The latter four variables are applied to provide a smoother end point detection curve. The derivative time is important since it provides the ability, in combination with the bandpass period, the number of bandpass cycles and filtering and averaging of the parameters that are observed, to display a derivative of the endpoint trace. It can in this respect be stated that small values of the derivative time result in an endpoint trace of high resolution but that also contains a high level of noise. Large values of the derivative time on the other hand result in an endpoint trace of low resolution but that contains a low level of noise.

Further, as part of the experiments of the invention, the window time and the window height have been correlated with the window size of the endpoint detection curve, the optimum window size has been determined by collecting and applying data that relate to a large number (125) of wafers. In addition, filtering has been added to the observed endpoint profile.

All of these data and experiments have led to the use of an endpoint detection profile that provides significantly improved results. That is the endpoint detection profile that is established under optimum conditions of the parameters of control that have previously been highlighted, an endpoint profile of high quality and dependability has been established for the monitoring of the BPSG CMP process.

It has been found that an initial dead time that is too small (according to the experiments, less than 45 second) results in an endpoint detection curve that is random and unstable.

Figure 4:
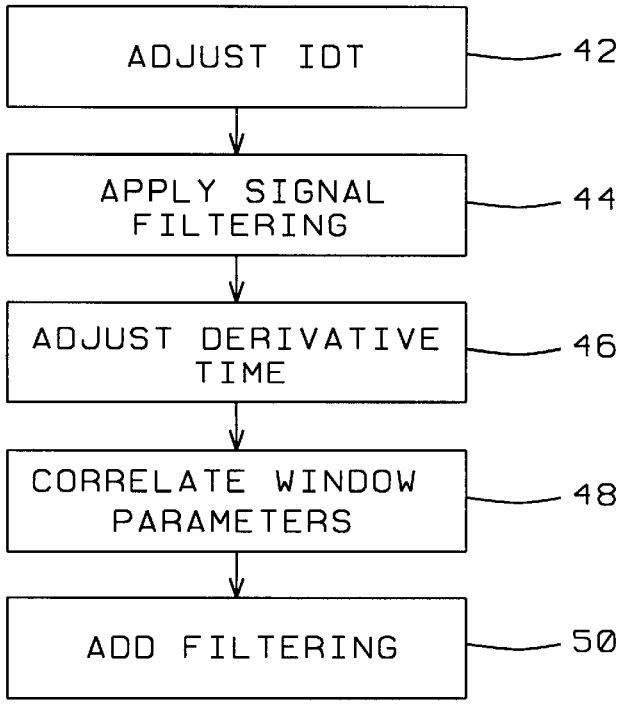
FIG. 4 shows a block diagram of the experimental steps that have been performed to develop and confirm the invention.

The experimental steps that have been used by the invention are highlighted in FIG. 4, these experimental steps have been studied by software simulation.

FIG. 4, step 42, adjustment of the initial dead time (IDT).

Three values have been selected for the IDT parameters, as follows:

- IDT less than 45 seconds; it was found that the endpoint curve is random and unstable, indicating that the random noise that is present in the monitoring system has as yet not been eliminated; the endpoint was detected at 41 seconds after start of polishing, an overpolish of 3 seconds was applied
- IDT 45 seconds, it was found that the endpoint detection curve is predictable; the endpoint was detected at 55 seconds after start of polishing, an overpolish of 4 seconds was applied
- IDT larger than 45 seconds, it was found that the endpoint curve is missing.

FIG. 4, step 44, use filtering of the simulated endpoint detection curve by applying averaging of the endpoint detection curve and by applying bandpass filters to the endpoint detection curve. Two conditions were applied:

- a bandpass filter was simulated as being switched off, the bandpass cycle was set to 0, the number of periods that are to be averaged was set to 2. An unsatisfactory endpoint detection curve was obtained by simulation using these parameters
- a bandpass filter was simulated as being switched on, the bandpass cycle was set to 1, the number of periods that are to be averaged was set to 2. A satisfactory endpoint detection curve was obtained by simulation using these parameters.

FIG. 4, step 46, adjust the derivative time. Three conditions were simulated:

- derivative time =0 seconds, an unsatisfactory endpoint detection curve was obtained by simulation using this parameter
- derivative time =1 seconds, a satisfactory endpoint detection curve was obtained by simulation using this parameter, and
- derivative time =10 seconds, an unsatisfactory endpoint detection curve was obtained by simulation using this parameter.

FIG. 4, step 48, correlate window parameters. To further highlight this step, the parameters-that have been selected for this step are listed below.

- IDT (selection range 0–9999 seconds): 45 seconds
- slope detect or peak count: slope-slope-none-none
- window height (selection range −99.99% to +99.99%): +0.02, −0.02, +0.02, −0.10
- window time (selection range 1–9999 seconds): 4-3-7-100
- number of windows out (selection range 1–99 or 0 for none): 2-1-2- none number of windows in (selection range 1–99 or 0 for none): none-none-none-none overpolish by rate (selection range 0%–999%): 7 overpolish by time (selection range 0–999 seconds): 0 period of signal to be averaged (selection range 1–50 seconds): 5 number of periods to average (selection range 1–50): 2 bandpass period (selection range 1–999 seconds): 12 bandpass cycles (selection range 1–100 or 0 for none): 1 derivative time (selection range 0–199 seconds): 1 display start level (selection range 10%–90%): 50 display gain (selection range 1–200): 200 high pass time constant (selection range 0–6000 seconds): 0 low pass time constant (selection range 0–6000 seconds): 9 median filter time (selection range 1–100 or 0 for none): none.

The above data must be read by realizing that the indicated values correspond by sequential location of their listing, where only one number is indicated behind a parameter this number has not been varied for the simulation. For instance, all second numbers in the sequence of their listing belong to one algorithm input, parameters that have no second number for that parameter take the value of the first (constant) number that is listed behind the parameter.

FIG. 4, step 50, filtering is further added to adjust the endpoint detection curve, the parameters selected for this function are as follows:

set a low pass time constant value to 0 seconds. It was found that the simulated endpoint detection curve was very rough, having irregular peaks. This curve would result in endpoint fail set a low pass time constant value to 9 seconds. It was found that the simulated endpoint detection curve was considerably smoother.

The conclusion has been drawn from the above listed data and experiments that by changing the variables by means of software simulation, a repeatable and reliable (constant) endpoint curve can be determined.

To confirm the results that have been obtained in using optimized conditions for the creation and CMP processing environment for the polishing a layer of BPSG, polishing performance has been measured. The results of this measurement are as follows:

the mean value of the thickness of the polished layer of BPSG is 5292 Angstrom, the target value for this layer is 5300 Angstrom the standard deviation is 193

CP=1.722, and

CPK=1.708 with as an objective to reach a value for CPK=1.33.

Of these parameters, CP indicates the Capability of Precision of the CMP process, $CPK=(1-|CA|)\times CP$ wherein CA is the Capability of Accuracy for the CMP process. For good process control of the CMP process, it is required that the value of CPK is relatively high, the value of Ca is relatively small. Increasing the value of CPK and/or decreasing the value of Ca reflects that the process control has improved. In the frequently applied six sigma method of process control, a value of CPK=1.33 is considered adequate for the achievement of an "A grade" level process of CMP.

From the above described experiments, it can be concluded that the invention, by using software simulation:

allows for BPSG endpoint curve data collection and data analysis the invention allows for fine-tuning the algorithm that is used for the processing of the signal that is received as a signal of the endpoint curve with as an objective to create a repeatable and dependable endpoint curve BPSG films of different thickness can be deposited and can be polished using the endpoint curve as the method to determined completion of polishing of the deposited layer of BPSG.

The following paragraphs summarize the invention.

The invention provides a method that can be used to improving Chemical Mechanical Polishing (CMP) of a film of boro-phosphate-silicate-glass (BPSG), using endpoint detection curves for determining endpoint of the process of CMP when applied to a deposited layer of BPSG, by collecting data relating to and affecting an CMP endpoint curve, by inputting the collected data to a CMP simulator software support program and by adjusting said inputted collected data with the objective of creating an acceptable endpoint detection curve.

The invention further provides a method for improving Chemical Mechanical Polishing (CMP) of a film of boro-phosphate-silicate-glass (BPSG), using endpoint detection curves for determining a desired thickness of a deposited layer of BPSG such that the deposited layer of BPSG can be optimally polished to a desired thickness, by determining the endpoint of the process of CMP by collecting data relating to an CMP endpoint curve, by inputting the collected data to a CMP simulator software support program, by adjusting said inputted collected data with the objective of creating an optimum endpoint detection curve for said deposited film of BPSG having a thickness, by recording the inputted collected data and said optimum endpoint detection curve, by repeating the steps of collecting data creating multiple data sets of inputted collected data and optimum endpoint detection curve, each data set being correlated with a deposited film of BPSG of a thickness, and by comparing the optimum endpoint detection curves, selecting from the endpoint detection curves a curve that best represents an endpoint detection curve, correlating said selected curve with the selected thickness of the deposited layer of BPSG.

Although the invention has been described and illustrated with reference to specific illustrative embodiments thereof, it is not intended that the invention be limited to those illustrative embodiments. Those skilled in the art will recognize that variations and modifications can be made without departing from the spirit of the invention. It is therefore intended to include within the invention all such variations and modifications which fall within the scope of the appended claims and equivalents thereof.

What is claimed is:

1. A method of improving Chemical Mechanical Polishing (CMP) of a film of boro-phosphate-silicate-glass (BPSG), using endpoint detection curves for determining endpoint of CMP when applied to a deposited layer of BPSG, comprising the steps of:

collecting data relating to affecting a CMP endpoint curve wherein said collected data comprises a film thickness parameter varying over time of said CMP; and adjusting said collected data having as objective creating a repeatable endpoint detection curve wherein said adjusting comprises filtering said collected data.

2. The method according to claim 1 wherein said step of adjusting said collected data further comprises adjusting initial dead time of said collected data.

3. The method according to claim 1 wherein said filtering comprises band pass or low pass filter.

4. A method for improving Chemical Mechanical Polishing (CMP) of a film of boro-phosphate-silicate-glass (BPSG), using endpoint detection curves for determining a desired thickness of a deposited layer of BPSG such that said deposited layer of BPSG can be optimally polished to a desired thickness, the endpoint of CMP when applied to a deposited layer of BPSG being determined using an endpoint detection curve, comprising the steps of:

collecting data relating to and determining a CMP endpoint curve, said data relating to a deposited film of BPSG having a thickness wherein said collected data comprises thickness parameter of said deposited film of BPSG varying over time of said CMP;

adjusting said collected data having as objective creating a repeatable endpoint detection curve for said deposited film of BPSG having a thickness, recording said collected data and said repeatable endpoint detection curve wherein said adjusting comprises filtering said collected data;

repeating said steps of collecting data relating to and determining a CMP endpoint curve through and including said step of adjusting said collected data, a cycle of repetition being performed for a different thickness of said deposited film of BPSG, creating multiple data sets of collected data and said repeatable endpoint detection curve, each data set being correlated with a deposited film of BPSG of a thickness; and comparing said repeatable endpoint detection curves derived as a result of said repetition, selecting from said endpoint detection curves a curve that best represents said repeatable endpoint detection curve, correlating said selected curve with a selected thickness of a deposited layer of BPSG belonging to this selected curve, retaining said selected thickness of said film of BPSG as an optimum thickness for future depositions of such a layer of BPSG.

5. The method according to claim 4 wherein said step of adjusting said collected data further comprises adjusting initial dead time of said collected data.

6. The method according to claim 4 wherein said filtering comprises band pass or low pass filter.

7. A method of improving Chemical Mechanical Polishing (CMP) of a film of boro-phosphate-silicate-glass (BPSG), using endpoint detection curves for determining endpoint of CMP when applied to a deposited layer of BPSG, comprising the steps of:

providing a semiconductor surface, said semiconductor surface having been provided with at least one partially completed semiconductor device in or on the surface thereof, a layer of boro-phosphate-silicate-glass (BPSG) having been deposited over the surface of said at least one partially completed semiconductor device;

providing a Chemical Mechanical Polishing (CMP) apparatus, said CMP apparatus comprising a wafer carrier for mounting said semiconductor surface and a polishing table for mounting a polishing pad, said wafer carrier and said polishing table being rotating parts of said CMP apparatus;

performing Chemical Mechanical Polishing (CMP) of the surface of said layer of BPSG;

monitoring and recording processing parameters relating to and affecting said process of CMP;

collecting data relating to and affecting a CMP endpoint curve for said polishing of the surface of said layer of BPSG wherein said collected data comprises thickness parameter of said layer of BPSG varying over time of said CMP; and adjusting said collected data having an objective creating a repeatable endpoint detection curve wherein said adjusting comprises filtering said collected data.

8. A method for determining a preferred starting thickness of a deposited film of boro-phosphate-silicate-glass (BPSG) for a process of Chemical Mechanical Polishing, using endpoint detection curves for said process of CMP, comprising the steps of:

providing a CMP apparatus, said CMP apparatus comprising a wafer carrier for mounting a semiconductor surface and a polishing table for mounting a polishing pad, said wafer carrier and said polishing table being rotating parts of said CMP apparatus;

providing a semiconductor surface, said semiconductor surface having been provided with at least one partially completed semiconductor device, a layer of BPSG having a thickness been deposited over the surface of said at least one partially completed semiconductor device;

performing a Chemical Mechanical Polishing of the surface of said layer of BPSG, monitoring and recording a CMP endpoint detection curve data for said surface of said layer of BPSG wherein said CMP endpoint detection curve data comprises thickness parameter of said layer of BPSG varying over time of said CMP;

adjusting said monitored and recorded CMP endpoint detection curve data, having as objective creating a repeatable CMP endpoint detection curve for said deposited film of BPSG having a thickness, recording said repeatable CMP endpoint detection curve data wherein said adjusting comprises filtering said monitored and recorded CMP endpoint detection curve data;

repeating said steps of providing a semiconductor surface, whereby said thickness is a thickness that differs from all previously applied layers of BPSG thicknesses, said step to be repeated up through and including said step of adjusting said monitored and recorded CMP endpoint detection curve data, having as objective creating said repeatable CMP endpoint detection curve for said deposited layer of BPSG having a thickness, creating a multiplicity of repeatable CMP endpoint detection curves for said multiplicity of applied layers of BPSG;

determining from said multiplicity of repeatable CMP endpoint detection curves a CMP endpoint detection curve therewith a layer of BPSG having a thickness whereby said CMP endpoint detection curve for all of said layers of BPSG is a repeatable CMP endpoint detection curve, resulting in optimum a repeatable CMP endpoint detection curve;

correlating said selected optimum CMP endpoint detection curve with said thickness of said layer of BPSG, providing a thickness at which said layer of BPSG must be deposited in order to provide a dependable CMP end-point signal profile during a process of CMP of this film.

9. A method for optimizing pre-layer BPSG film thickness for use in Chemical Mechanical Polishing process, comprising the steps of:

providing on a multiplicity of surfaces a first film of BPSG having a first film thickness;

providing Chemical Mechanical Polishing (CMP) of said first film of BPSG;

monitoring and recording CMP endpoint detection curve data for a surface of said layer of BPSG having a thickness, using a CMP endpoint detection profile that is activated by reaching a surface that is of a different composition than said first film, providing a multiplicity of CMP endpoint detection profiles wherein said CMP endpoint detection curve data comprises chemical composition of chamber ambient varying over time of said CMP;

adjusting said monitored and recorded CMP endpoint detection curve data, having as objective creating a repeatable CMP endpoint detection curve for said deposited film of BPSG having a thickness, recording said repeatable CMP endpoint detection curve data wherein said adjusting comprises filtering said monitored and recorded CMP endpoint detection curve data;

repeating said providing Chemical Mechanical Polishing and monitoring and recording for second, third, and more BPSG films having film thicknesses of either greater or lesser than said first film; and review deviation for said end-point CMP profile for each of the first, second, third more CMP end-point profiles, selecting an optimum profile, thereby selecting an optimum film thickness for deposition of said layer of BPSG.

* * * * *